US005344579A

United States Patent [19]

Ohtani et al.

[11] Patent Number: 5,344,579

[45] Date of Patent: Sep. 6, 1994

[54] FRICTION MODIFIER COMPOSITIONS AND THEIR USE

[75] Inventors: Hiroko Ohtani, Brentwood; Rolfe J. Hartley, St. Louis, both of Mo.

[73] Assignee: Ethyl Petroleum Additives, Inc., Richmond, Va.

[21] Appl. No.: 109,764

[22] Filed: Aug. 20, 1993

[51] Int. Cl.[5] ..... C10M 137/00; C10M 141/06; C10M 139/00

[52] U.S. Cl. ..... 252/51.50 R; 252/49.6; 252/49.8

[58] Field of Search ..... 252/51.5 R, 49.6, 49.9

[56] References Cited

U.S. PATENT DOCUMENTS

| | | | |
|---|---|---|---|
| 4,770,816 | 9/1988 | Miyamoto et al. | 252/51.5 R |
| 5,078,893 | 1/1992 | Ryer et al. | 252/51.5 R |
| 5,089,157 | 2/1992 | Trivett | 252/51.5 R |
| 5,160,648 | 3/1992 | Stecke | 252/51.5 R |
| 5,254,277 | 10/1993 | Gentit et al. | 252/51.5 R |

*Primary Examiner*—Jacqueline V. Howard
*Attorney, Agent, or Firm*—John F. Sieberth

[57] ABSTRACT

A new friction modifier system is described. It has the capability of establishing and maintaining a substantially constant static breakaway coefficient of friction between a pair of friction surfaces that are periodically frictionally engaged with each other. Also this system is capable of maintaining a substantially constant ratio between (i) the low speed dynamic coefficient of friction of such friction surfaces, and (ii) the (midpoint) dynamic coefficient of friction of such friction surfaces. The additive composition yielding these results comprises at least the following components: a) a hydroxyalkyl aliphatic imidazoline in which the hydroxyalkyl group contains from 2 to about 4 carbon atoms, and in which the aliphatic group is an acyclic hydrocarbyl group containing from about 10 to about 25 carbon atoms; and b) a di(hydroxyalkyl) aliphatic tertiary amine in which the hydroxyalkyl groups, being the same or different, each contain from 2 to about 4 carbon atoms, and in which the aliphatic group is an acyclic hydrocarbyl group containing from about 10 to about 25 carbon atoms.

27 Claims, No Drawings

FRICTION MODIFIER COMPOSITIONS AND THEIR USE

TECHNICAL FIELD

This invention relates to friction modification between a plurality of surfaces which transmit power through frictional engagement with each other. More particularly this invention relates to improving the performance of frictionally engageable surfaces which during operation under actual service conditions are periodically brought into frictional engagement with each other, such as in a wet clutch or wet brake system.

BACKGROUND

There are numerous situations in which it is necessary or desirable to employ friction modifiers in lubricant compositions in order to beneficially control frictional characteristics between the two sliding surfaces that are frictionally engageable with each other. For example, the useful life of automatic transmissions can be improved by selection and use of lubricants containing suitable friction modifier systems. However, despite improvements made in the art of friction modification, a need exists for improved friction modifier systems that have the capability of establishing and maintaining a substantially constant frictional characteristics between a pair of friction surfaces that are periodically frictionally engaged with each other such as occurs in the operation of automatic transmission shifting clutches, and like power transmission apparatus. In particular, a need exists for friction modifier systems which have the capability of establishing and maintaining a substantially constant static breakaway coefficient of friction ($\mu_s$) of such friction surfaces. Moreover another need is for friction modifier systems which have the additional capability of also maintaining a substantially constant ratio between (i) the low speed dynamic ($\mu_0$) coefficient of friction of such friction surfaces, and (ii) the (midpoint) dynamic coefficient of friction ($\mu_d$) of such friction surfaces.

The static breakaway coefficient of friction reflects the relative tendency of engaged parts, such as clutch packs, bands and drums, to slip under load. If this value is too low, the slippage can impair the driveability and safety of a vehicle in which such apparatus is utilized. Likewise, for maintaining proper shift-feel durability, the ratio of the low speed dynamic coefficient of friction (or the coefficient of friction at the end of engagement of friction surfaces) to the (midpoint) dynamic coefficient of friction between the engaged parts should be kept substantially constant during long periods of service in vehicles equipped with such apparatus. The ratio is often called as "static to dynamic ratio" or "rooster tail" in lubrication industry.

The development of effective friction modifiers is an empirical art where few if any guidelines exist, and where predictions concerning the operability of new untested systems are unreliable. Therefore, only after a proposed new system has been tested and found to be effective for its intended usage can valid predictions be made as to the effect of reasonable variations in the makeup of that system.

THE INVENTION

It has now been found possible to fulfill the foregoing need for a new friction modifier system that has the capability of establishing and maintaining a substantially constant static breakaway coefficient of friction between a pair of friction surfaces that are periodically frictionally engaged with each other. This system has also been found capable of maintaining a substantially constant ratio between (i) the low speed dynamic coefficient of friction of such friction surfaces, and (ii) the (midpoint) dynamic coefficient of friction of such friction surfaces. Accordingly, this invention makes available the frictional performance properties needed for example for new generation automatic transmission shifting clutches.

Pursuant to this invention it has been found that by combining two essential additive components a friction modifier system is provided that exhibits the properties needed to fulfill the foregoing needs. Neither additive component by itself can fulfill these needs. Thus the additives, when utilized in concert with each other, cooperate in some unknown way to provide a new beneficial result which neither component can exhibit on its own.

In one of its embodiments this invention thus provides a lubricant additive composition which comprises at least the following components:

a) a hydroxyalkyl aliphatic imidazoline in which the hydroxyalkyl group contains from 2 to about 4 carbon atoms, and in which the aliphatic group is an acyclic hydrocarbyl group containing from about 10 to about 25 carbon atoms; and b) a di(hydroxyalkyl) aliphatic tertiary amine in which the hydroxyalkyl groups, being the same or different, each contain from 2 to about 4 carbon atoms, and in which the aliphatic group is an acyclic hydrocarbyl group containing from about 10 to about 25 carbon atoms;

said components a) and b) being present in a mol ratio in the range of about 0.005 to about 0.50, and preferably about 0.02 to about 0.1, mol of a) per mol of b). In another embodiment this invention provides a lubricant composition which comprises a major amount of at least one oil of lubricating viscosity and a friction modifying amount of the foregoing combination of components a) and b). A still further embodiment is a method of maintaining a substantially constant static breakaway coefficient of friction between a pair of friction surfaces that are periodically frictionally engaged with each other. This method comprises contacting such friction surfaces with a lubricant composition which comprises a major amount of at least one oil of lubricating viscosity and an friction modifying amount of the combination of components a) and b) in the proportions described above. These and other embodiments of this invention will become still further apparent from the ensuing description and the appended claims.

Component a)

The hydroxyalkyl aliphatic imidazolines suitable for use in the practice of this invention are characterized by having in the 1-position on the ring a hydroxyalkyl group that contains from 2 to about 4 carbon atoms, and by having in the adjacent 2-position on the ring a noncyclic hydrocarbyl group containing about 10 to about 25 carbon atoms. While the hydroxyl group of the hydroxyalkyl group can be in any position thereof, it preferably is on the $\beta$-carbon atom, such as 2-hydroxyethyl, 2-hydroxypropyl or 2-hydroxybutyl. Typically the aliphatic group is a saturated or olefinically unsaturated hydrocarbyl group, and when olefinically unsaturated, the aliphatic group may contain one, two or three such double bonds. Component a) may be a single substantially pure compound or it may be a mixture of compounds in which the aliphatic group has an average of from about 10 to about 25 carbon atoms. Preferably the aliphatic group has about 15 to about 19 carbon atoms, or an average of about 15 to about 19 carbon atoms. Most preferably the aliphatic group has, or averages, about 17 carbon atoms. The aliphatic group(s) may be straight or branched chain groups, with substantially straight chain groups being preferred. A particularly preferred compound is 1-hydroxyethyl-2-heptadecenyl imidazoline (CAS-No. 27136-73-8).

It will thus be clear that component a) can be a single compound or a mixture of compounds meeting the structural criteria described above.

Component b)

This component has a nitrogen atom to which are bonded two hydroxyalkyl groups and one non-cyclic aliphatic hydrocarbyl group having about 10 to about 25 carbon atoms, and preferably about 13 to about 19 carbon atoms. The hydroxyalkyl groups of these tertiary amines can be the same or different, but each contains from 2 to about 4 carbon atoms. The hydroxyl groups can be in any position in the hydroxyalkyl groups, but preferably are in the $\beta$ position. Preferably the two hydroxyalkyl groups in component b) are the same, and most preferably are 2-hydroxyethyl groups. The aliphatic group of these tertiary amines can be straight or branched chain and it can be saturated or olefinically unsaturated and if unsaturated, it typically contains from one to three olefinic double bonds. Component b) can have a single type of aliphatic group or it can comprise a mixture of compounds having different aliphatic groups in which the average number of carbon atoms falls within the foregoing range of from about 10 to about 25 carbon atoms.

From the foregoing it will be clear that component b) can be a single compound or a mixture of compounds meeting the structural criteria described above.

Other additive components

Preferably the compositions of this invention contain at least one oil-soluble phosphorus-containing ashless dispersant present in amount such that the ratio of phosphorus in said ashless dispersant to said component b) is in the range of about 0.1 to about 1.0 part by weight of phosphorus per part by weight of component b); and/or at least one oil-soluble boron-containing ashless dispersant present in amount such that the ratio of boron in said ashless dispersant to said component b) is in the range of about 0.03 to about 0.3 part by weight of boron per part by weight of component b). Most preferably, the compositions of this invention contain at least one oil-soluble phosphorus- and boron-containing ashless dispersant present in amount such that the ratio of phosphorus in said ashless dispersant to said component b) is in the range of about 0.1 to about 0.5 part by weight of phosphorus per part by weight of component b), and such that the ratio of boron in said ashless dispersant to said component b) is in the range of about 0.05 to about 0.15 part by weight of boron per part by weight of component b).

The foregoing phosphorus- and/or boron-containing ashless dispersants can be formed by phosphorylating and/or boronating a ashless dispersant having basic nitrogen and/or at least one hydroxyl group in the molecule, such as a succinimide dispersant, succinic ester dispersant, succinic ester-amide dispersant, Mannich base dispersant, hydrocarbyl polyamine dispersant, or polymeric polyamine dispersant.

The polyamine succinimides in which the succinic group contains a hydrocarbyl substituent containing at least 30 carbon atoms are described for example in U.S. Pat. Nos. 3,172,892; 3,202,678; 3,216,936; 3,219,666; 3,254,025; 3,272,746; and 4,234,435, the disclosures of which are incorporated herein by reference. The alkenyl succinimides may be formed by conventional methods such as by heating an alkenyl succinic anhydride, acid, acid-ester, acid halide, or lower alkyl ester with a polyamine containing at least one primary amino group. The alkenyl succinic anhydride may be made readily by heating a mixture of olefin and maleic anhydride to about 180°-220° C. The olefin is preferably a polymer or copolymer of a lower monoolefin such as ethylene, propylene, 1-butene, isobutene and the like. The more preferred source of alkenyl group is from polyisobutene having a GPC number average molecular weight of up to 10,000 or higher, preferably in the range of about 500 to about 2,500, and most preferably in the range of about 800 to about 1,200.

As used herein the term "succinimide" is meant to encompass the completed reaction product from reaction between one or more polyamine reactants and a hydrocarbon-substituted succinic acid or anhydride (or like succinic acylating agent), and is intended to encompass compounds wherein the product may have amide, amidine, and/or salt linkages in addition to the imide linkage of the type that results from the reaction of a primary amino group and an anhydride moiety.

Alkenyl succinic acid esters and diesters of polyhydric alcohols containing 2–20 carbon atoms and 2–6 hydroxyl groups can be used in forming the phosphorus- and/or boron-containing ashless dispersants. Representative examples are described in U.S. Pat. Nos. 3,331,776; 3,381,022; and 3,522,179. The alkenyl succinic portion of these esters corresponds to the alkenyl succinic portion of the succinimides described above.

Suitable alkenyl succinic ester-amides for forming the phosphorylated and/or boronated ashless dispersant are described for example in U.S. Pat. Nos. 3,184,474; 3,576,743; 3,632,511; 3,804,763; 3,836,471; 3,862,981; 3,936,480; 3,948,800; 3,950,341; 3,957,854; 3,957,855; 3,991,098; 4,071,548; and 4,173,540.

Hydrocarbyl polyamine dispersants that can be phosphorylated and/or boronated are generally produced by reacting an aliphatic or alicyclic halide (or mixture thereof) containing an average of at least about 40 carbon atoms with one or more amines, preferably polyalkylene polyamines. Examples of such hydrocarbyl polyamine dispersants are described in U.S. Pat. Nos. 3,275,554; 3,394,576; 3,438,757; 3,454,555; 3,565,804; 3,671,511; and 3,821,302.

In general, the hydrocarbyl-substituted polyamines are high molecular weight hydrocarbyl-N-substituted polyamines containing basic nitrogen in the molecule. The hydrocarbyl group typically has a number average molecular weight in the range of about 750–10,000, more usually in the range of about 1,000–5,000, and is derived from a suitable polyolefin. Preferred hydrocarbyl-substituted amines or polyamines are prepared from polyisobutenyl chlorides and polyamines having from 2 to about 12 amine nitrogen atoms and from 2 to about 40 carbon atoms.

Mannich polyamine dispersants which can be utilized in forming the phosphorylated and/or boronated ashless dispersant is a reaction product of an alkyl phenol, typically having a long chain alkyl substituent on the ring, with one or more aliphatic aldehydes containing from 1 to about 7 carbon atoms (especially formaldehyde and derivatives thereof), and polyamines (especially polyalkylene polyamines). Examples of Mannich condensation products, and methods for their production are described in U.S. Pat. Nos. 2,459,112; 2,962,442; 2,984,550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,904,595; 3,957,746; 3,980,569; 3,985,802; 4,006,089; 4,011,380; 4,025,451; 4,058,468; 4,083,699; 4,090,854; 4,354,950; and 4,485,023.

The preferred hydrocarbon sources for preparation of the Mannich polyamine dispersants are those derived from substantially saturated petroleum fractions and olefin polymers, preferably polymers of mono-olefins having from 2 to about 6 carbon atoms. The hydrocarbon source generally contains at least about 40 and preferably at least about 50 carbon atoms to provide substantial oil solubility to the dispersant. The olefin polymers having a GPC number average molecular weight between about 600 and 5,000 are preferred for reasons of easy reactivity and low cost. However, polymers of higher molecular weight can also be used. Especially suitable hydrocarbon sources are isobutylene polymers.

The preferred Mannich base dispersants for this use are Mannich base ashless dispersants formed by condensing about one molar proportion of long chain hydrocarbon-substituted phenol with from about 1 to 2.5 moles of formaldehyde and from about 0.5 to 2 moles of polyalkylene polyamine.

Polymeric polyamine dispersants suitable for preparing phosphorylated and/or boronated ashless dispersants are polymers containing basic amine groups and oil solubilizing groups (for example, pendant alkyl groups having at least about 8 carbon atoms). Such materials are illustrated by interpolymers formed from various monomers such as decyl methacrylate, vinyl decyl ether or relatively high molecular weight olefins, with aminoalkyl acrylates and aminoalkyl acrylamides. Examples of polymeric polyamine dispersants are set forth in U.S. Pat. Nos. 3,329,658; 3,449,250; 3,493,520; 3,519,565; 3,666,730; 3,687,849; and 3,702,300.

The various types of ashless dispersants described above can be phosphorylated by procedures described in U.S. Pat. Nos. 3,184,411; 3,342,735; 3,403,102; 3,502,607; 3,511,780; 3,513,093; 3,513,093; 4,615,826; 4,648,980; 4,857,214 and 5,198,133.

Methods that can be used for boronating (borating) the various types of ashless dispersants described above are described in U.S. Pat. Nos. 3,087,936; 3,254,025; 3,281,428; 3,282,955; 2,284,409; 2,284,410; 3,338,832; 3,344,069; 3,533,945; 3,658,836; 3,703,536; 3,718,663; 4,455,243; and 4,652,387.

Preferred procedures for phosphorylating and boronating ashless dispersants such as those referred to above are set forth in U.S. Pat. Nos. 4,857,214 and 5,198,133.

Various other additive components can be present in the compositions of this invention in order to provide additional desirable properties engendered by use of such additives. Thus any additive can be included so long as (a) it is compatible with and soluble or at least capable of existing as a shelf-stable dispersion in the finished liquid compositions of this invention, (b) it does not contribute to the presence of more than 100 ppm of metal in the finished oleaginous liquid composition, and (c) it does not adversely affect the viscometrics or stability needed in the finished functional fluid composition or otherwise materially adversely impair the performance of the finished composition.

Described below are illustrative examples of the types of additives that may be employed in the power transmission fluids of this invention.

Seal performance (elastomer compatibility) improvers such as dialkyl diesters typified by (a) the adipates, azelates, and sebacates of $C_8$–$C_3$ alkanols (or mixtures thereof), and (b) the phthalates of $C_4$–$C_3$ alkanols (or mixtures thereof), or combinations of (a) and (b) can be used. Examples of such materials include the n-octyl, 2-ethylhexyl, isodecyl, and tridecyl diesters of adipic acid, azelaic acid, and sebacic acid, and the n-butyl, isobutyl, pentyl, hexyl, heptyl, octyl, nonyl, decyl, undecyl, dodecyl, and tridecyl diesters of phthalic acid. Also useful are aromatic hydrocarbons of suitable viscosity such as Panasol AN-3N; products such as Lubrizol 730; polyol esters such as Emery 2935, 2936, and 2939 esters from the Emery Group of Henkel Corporation and Hatcol 2352, 2962, 2925, 2938, 2939, 2970, 3178, and 4322 polyol esters from Hatco Corporation.

The compositions may contain one or more antioxidants, e.g., one or more phenolic antioxidants, aromatic amine antioxidants, sulphurized phenolic antioxidants, and organic phosphites, among others. Examples include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-tert-butylphenol), mixed methylene-bridged polyalkyl phenols, 4,4'-thiobis(2-methyl-6-tert-butylphenol), N,N'-di-sec-butyl-p-phenylenediamine, 4-isopropylaminodiphenyl amine, phenyl-$\alpha$-naphthyl amine, and phenyl-$\beta$-naphthyl amine.

Corrosion inhibitors comprise another type of additive that can be used in the finished additive compositions and oils. Examples include dimer and trimer acids, such as are produced from tall oil fatty acids, oleic acid, linoleic acid, or the like. Products of this type include the dimer and trimer acids sold under the HYSTRENE trademark by the Humco Chemical Division of Witco Chemical Corporation and under the EMPOL trademark by Emery Chemicals. Other useful corrosion inhibitors include the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable corrosion inhibitors include ether amines; acid phosphates; amines; polyethoxylated compounds such as ethoxylated amines, ethoxylated phenols, and ethoxylated alcohols; imidazolines; aminosuccinic acids or derivatives thereof, and the like.

Foam inhibitors are likewise can be used in the finished oils and additive compositions of this invention.

These include silicones, polyacrylates, surfactants, and the like.

Copper corrosion inhibitors constitute another class of additives which can be employed in the compositions of this invention. Such compounds include thiazoles, triazoles and thiadiazoles. Examples of such compounds include benzotriazole, tolyltriazole, octyltriazole, decyltriazole, dodecyltriazole, 2-mercapto benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-(bis)hydrocarbyldithio)-1,3,4-thiadiazoles.

Supplementary friction modifiers possibly can be used, but extreme care should be exercised in evaluating proposed candidates for such supplemental use to be certain that the candidate material(s) will not interfere adversely with the excellent frictional properties afforded by the friction modifier system of this invention that is being used in any given situation. Candidate materials that may be tested for suitability as supplemental friction modifiers for use in the practice of this invention include ethoxylated aliphatic amines differing in structure from the any of the materials herein defined for use as component b), aliphatic amines, aliphatic fatty acid amides, aliphatic carboxylic acids, aliphatic carboxylic esters, aliphatic carboxylic ester-amides, aliphatic phosphonates, aliphatic phosphates, aliphatic thiophosphonates, aliphatic thiophosphates, etc., wherein the aliphatic group usually contains above about eight carbon atoms so as to render the compound suitably oil soluble. Also suitable are aliphatic substituted succinimides formed by reacting one or more aliphatic succinic acids or anhydrides with ammonia.

Metal-containing detergents such as calcium sulfurized phenates, magnesium sulfurized phenates, calcium sulfonates, magnesium sulfonates, etc. can also be used. However, as noted above, if an oil-soluble or oil-dispersible phenate or sulfonate is used it should be proportioned such that the finished fluid contains no more than about 100 ppm of metal, and preferably no more than about 50 ppm of metal.

Ashless dispersants can be used either in lieu of or in addition to the preferred phosphorylated ashless dispersants, preferred boronated ashless dispersants and/or particularly preferred phosphorylated and boronated ashless dispersants described hereinabove. Useful oil-soluble ashless dispersants when neither phosphorylated nor boronated that can be used if desired include those non-phosphorylated and non-boronated ashless dispersants referred to in U.S. Pat. Nos. 2,459,112; 2,962,442; 2,984,550; 3,036,003; 3,166,516; 3,172,892; 3,184,474; 3,202,678; 3,216,936; 3,219,666; 3,236,770; 3,254,025; 3,272,746; 3,275,554; 3,329,658; 3,331,776; 3,368,972; 3,381,022; 3,394,576; 3,413,347; 3,438,757; 3,442,808; 3,448,047; 3,449,250; 3,454,497; 3,454,555; 3,459,661; 3,493,520; 3,519,565; 3,522,179; 3,539,633; 3,558,743; 3,565,804; 3,576,743; 3,586,629; 3,591,598; 3,600,372; 3,632,511; 3,634,515; 3,649,229; 3,666,730; 3,671,511; 3,687,849; 3,697,574; 3,702,300; 3,703,536; 3,704,308; 3,725,277; 3,725,480; 3,726,882; 3,736,357; 3,751,365; 3,756,953; 3,793,202; 3,798,165; 3,798,247; 3,803,039; 3,804,763; 3,821,302; 3,836,471; 3,862,981; 3,872,019; 3,904,595; 3,936,480; 3,948,800; 3,950,341; 3,957,746; 3,957,854; 3,957,855; 3,980,569; 3,985,802; 3,991,098; 4,006,089; 4,011,380; 4,025,451; 4,058,468; 4,071,548; 4,083,699; 4,090,854; 4,173,540; 4,234,435; 4,354,950; and 4,485,023.

Still other components that can be present include lubricity agents such as sulfurized fats, sulfurized isobutylene, dialkyl polysulfides, and sulfur-bridged phenols such as nonylphenol polysulfide. Dyes, pour point depressants, viscosity index improvers, air release agents, and many other known types of additives can also be included in the finished compositions produced and/or used in the practice of this invention.

In selecting any of the foregoing optional additives, it is important to ensure that the selected component(s) are soluble or stably dispersible in the additive package and finished oleaginous liquid composition (ATF, etc.), are compatible with the other components of the composition, and do not interfere significantly with the performance properties of the composition, such as the friction, viscosity and/or shear stability properties, needed or at least desired in the overall finished oleaginous composition.

In general, the additive components are employed in the oleaginous liquids in minor amounts sufficient to improve the performance characteristics and properties of the base fluid. The amounts will thus vary in accordance with such factors as the viscosity characteristics of the base fluid employed, the viscosity characteristics desired in the finished fluid, the service conditions for which the finished fluid is intended, and the performance characteristics desired in the finished fluid. However, generally speaking, the following concentrations (weight percent) of the additional components (active ingredients) in the base fluids are illustrative:

| | Typical Range | Preferred Range |
|---|---|---|
| P-containing dispersant | 0.2–15 | 0.5–5 |
| Seal performance improver | 0–30 | 0–20 |
| Antioxidant | 0–1 | 0.25–1 |
| Corrosion inhibitor | 0–0.5 | 0.01–0.1 |
| Foam inhibitor | 0–0.01 | 0.0001–0.005 |
| Copper corrosion inhibitor | 0–0.5 | 0.01–0.05 |
| Friction modifier(s) | 0–1 | 0.05–0.5 |
| Lubricity agent | 0–1.5 | 0.5–1 |
| Viscosity index improver | 0–15 | 0–12 |
| Dye | 0–0.05 | 0.015–0.035 |

It is to be clearly understood that the foregoing description of additives which can be present in the oils and concentrations in which they may be present, is not under any circumstances to be construed as imposing, by implication or otherwise, any limitation on the composition or type of lubricating oil or functional fluid composition that may be employed in the practice of this invention. This description is merely being presented to forestall hypertechnical interpretations of the "best mode" requirement of the current patent statute. The only requirements as regards the oil are that the oil must contain a phosphorus-containing dispersant which optionally (and preferably but not necessarily) also contains boron, and that the oil composition be suitable for its intended usage. The remainder of the components in the finished oil of lubricating viscosity are matters well within the skill and expertise of lubricant manufacturers and their additive suppliers.

It will be appreciated that the individual components can be separately blended into the base fluid or can be blended therein in various subcombinations, if desired. Ordinarily, the particular sequence of such blending steps is not critical. Moreover, such components can be blended in the form of separate solutions in a diluent. It is preferable, however, to blend the components used in the form of an additive concentrate as this simplifies the blending operations, reduces the likelihood of blending errors, and takes advantage of the compatibility and solubility characteristics afforded by the overall concentrate.

Friction modification of wet clutch systems is typically evaluated on an SAE No. 2 friction apparatus. In this test, the motor and flywheel of the friction machine (filled with fluid to be tested) are accelerated to constant speed, the motor is shut off and the flywheel speed is decreased to zero by application of the clutch. The clutch plates are then released, the flywheel is again accelerated to constant speed, and the clutch pack which is immersed in the test fluid is engaged again. This process is repeated many times with each clutch engagement being called a cycle.

During the clutch application, friction torque is recorded as a function of time. The friction data obtained are either the torque traces themselves or friction coefficients calculated from the torque traces. The shape of the torque trace desired is set by the auto manufacturers. One way of expressing this shape mathematically, is to determine the coefficient of friction (a) when the flywheel speed is midway between the maximum constant speed selected and zero speed (such coefficient of friction measurement is referred to herein as (midpoint) dynamic coefficient of friction ($\mu_d$)) and (b) when as the flywheel speed approaches zero rpm (such coefficient of friction measurement is referred to herein as low speed dynamic coefficient of friction ($\mu_0$)). Such coefficient of friction can then be used to determine the so-called "static to dynamic ratio" or "rooster tail" which is expressed as $\mu_0/\mu_d$ in which case the typical optimum value thereof is about 1. As the $\mu_0/\mu_d$ increasingly exceeds 1, a transmission will typically exhibit shorter harsher shifts as it changes gears. On the other hand, as $\mu_0/\mu_d$ decreases below 1, there is an increasingly greater danger of clutch slippage when the transmission changes gears.

In addition to determining midpoint dynamic coefficient of friction ($\mu_d$) and low speed dynamic coefficient of friction ($\mu_0$) the static breakaway coefficient of friction ($\mu_s$) is also determined. This is achieved by rotating the composition plates under load of slow speed while locking the steel reaction plates and preventing them from rotating. The coefficient of friction is then measured until smooth slippage occurs and the static breakaway coefficient of friction observed is recorded as $\mu_s$. The higher the value of $\mu_s$, the less chance there is of clutch slippage at low speeds. Accordingly, the most desirable automatic transmission formulations would exhibit both a value of $\mu_0/\mu_d$ close to 1 and a high value for $\mu_s$.

While a number of automatic transmission fluids can achieve target values of $\mu_s$ and $\mu_0/\mu_d$, after a certain number of cycles, it becomes increasingly more difficult to sustain such target values as the number of cycles is increased. The ability of an ATF to sustain such desired friction properties is its friction durability. Thus the greater the friction durability of an ATF, the better.

The specific conditions for the Japanese friction test are shown in Table 1.

TABLE 1

| Japanese Friction Test Conditions | |
|---|---|
| Test Variable | Value |
| Friction Material | SD-1777X |

TABLE 1-continued

| Japanese Friction Test Conditions | |
|---|---|
| Test Variable | Value |
| Number of Friction Plates | 3 |
| Clutch Plate Arrangement | S-F-S-F-S-F-S* |
| Test Temperature | 100° C. |
| Energy | 24400 J |
| Motor Speed for Dynamic Test | 3600 rpm |
| Motor Speed for Static Test | 0.72 rpm |
| Apply Pressure to the Piston | 235 kPa |
| Test Duration | 5000 cycles |

*S: Steel plate;
F: Friction plate.

Table 2 shows the specific conditions for the Ford MERCON ® Clutch Durability Test.

TABLE 2

| Ford MERCON ® Clutch Durability Test Conditions | |
|---|---|
| Test Variable | Value |
| Friction Material | SD-1777 |
| Number of Friction Plates | 2 |
| Clutch Plate Arrangement | S-F-S-S-F-S |
| Test Temperature | 115° C. |
| Energy | 20740 J |
| Motor Speed for Dynamic Test | 3600 rpm |
| Motor Speed for Static Test | 4.37 rpm |
| Apply Pressure to the Piston | 275 kPa |
| Test Duration | 15000 cycles |

Illustrative compositions suitable for use in the practice of this invention are presented in the following Examples 1–6 wherein all parts and percentages are by weight. Component a) is 1-hydroxyethyl-2-hetadecenyl imidazoline, and component b) is bis(2hydroxyethyl) tallow amine. The polyisobutenyl succinimide contains both phosphorus and boron and is formed substantially as described in Example 1A of U.S. Pat. No. 4,857,214. The succinimide used for making the phosphorylated and boronated polyisobutenyl succinimide used in Examples 1 and 2 and Comparative Examples A and B has an acylating agent:polyamine mol ratio of approximately 2.0:1 whereas the succinimide used for making the phosphorylated and boronated polyisobutenyl succinimide used in Examples 3, 4, 5, 6 and Comparative Example C has an acylating agent:polyamine ratio of approximately 1.6:1. The copper corrosion inhibitor is 2-tert-dodecyldithio-5-mercapto-1, 3,4-thiodiazole, the antifoam agent is a dimethyl silicone oil employed as a 4% solution in diluent oil, and the base mineral oil is Exxon FN 1391.

In the following Examples, various proprietary additive components are employed.

SUL-PERM 10S, available from the Keil Chemical Division of Ferro Corporation is reported to be a sulfurized fatty ester having a sulfur content of about 10% by weight.

Naugalube 438L, available from Uniroyal Chemical Company, is reported to be a nonylated diphenyl amine antioxidant, containing predominantly 4,4'-dinonylated diphenylamine.

OLOA 216C available from Chevron Chemical Company, Oronite Division, is reported to be a calcium hydroxide salt of a sulfurized alkylphenate having a nominal TBN of about 150.

PC-1244, available from Monsanto Chemical Company as M544, is reported to be primarily an acrylate polymer surfactant.

Mazawet 77, available from Mazer Chemical Company, is reported to be alkyl polyoxyalkylene ether.

TOMAH PA-14, available from Exxon Chemical Company, is reported to be 3-decyloxy propylamine.

Pluronic L-81, available from BASF Corporation, is reported to be a polyoxypropylene-polyoxyethylene block copolymer.

Acryloid 1263, available from Rohm & Haas Company, is reported to be a polymethacrylate ester copolymer viscosity index improver.

EXAMPLE 1

| Components | |
|---|---|
| Component a) | 0.003 |
| Component b) | 0.120 |
| Phosphorylated and boronated ashless dispersant | 3.771 |
| Sul-Perm 10S | 0.480 |
| Copper corrosion inhibitor | 0.040 |
| Antifoam agent | 0.060 |
| Naugalube 438L | 0.261 |
| OLOA 216C | 0.050 |
| Octanoic acid | 0.050 |
| Tomah PA-14 | 0.050 |
| Pluronic L-81 | 0.010 |
| Mazawet 77 | 0.050 |
| PC 1244 | 0.030 |
| Diluent oil | 1.198 |
| Viscosity index improver | 5.800 |
| Red dye | 0.025 |
| Mineral oil | 88.002 |

EXAMPLE 2

| Components | |
|---|---|
| Component a) | 0.003 |
| Component b) | 0.120 |
| Phosphorylated and boronated ashless dispersant | 3.771 |
| Copper corrosion inhibitor | 0.040 |
| Antifoam agent | 0.060 |
| Naugalube 438L | 0.261 |
| OLOA 216C | 0.050 |
| Octanoic acid | 0.050 |
| Tomah PA-14 | 0.050 |
| Pluronic L-81 | 0.010 |
| Mazawet 77 | 0.050 |
| PC 1244 | 0.030 |
| Diluent oil | 1.705 |
| Viscosity index improver | 5.800 |
| Red dye | 0.025 |
| Mineral oil | 87.975 |

EXAMPLE 3

| Components | |
|---|---|
| Component a) | 0.003 |
| Component b) | 0.120 |
| Phosphorylated and boronated ashless dispersant | 3.771 |
| Sul-Perm 10S | 0.480 |
| Copper corrosion inhibitor | 0.040 |
| Antifoam agent | 0.060 |
| Naugalube 438L | 0.261 |
| OLOA 216C | 0.050 |
| Octanoic acid | 0.050 |
| Tomah PA-14 | 0.050 |
| Pluronic L-81 | 0.010 |
| Mazawet 77 | 0.050 |
| PC 1244 | 0.030 |
| Diluent oil | 1.198 |
| Viscosity index improver | 5.800 |
| Red dye | 0.025 |
| Mineral oil | 88.002 |

EXAMPLE 4

| Components | |
|---|---|
| Component a) | 0.007 |
| Component b) | 0.120 |
| Phosphorylated and boronated ashless dispersant | 3.771 |
| Sul-Perm 10S | 0.480 |
| Copper corrosion inhibitor | 0.040 |
| Antifoam agent | 0.060 |
| Naugalube 438L | 0.261 |
| OLOA 216C | 0.050 |
| Octanoic acid | 0.050 |
| Tomah PA-14 | 0.050 |
| Pluronic L-81 | 0.010 |
| Mazawet 77 | 0.050 |
| PC 1244 | 0.030 |
| Diluent oil | 1.221 |
| Viscosity index improver | 5.800 |
| Red dye | 0.025 |
| Mineral oil | 87.975 |

EXAMPLE 5

| Components | |
|---|---|
| Component a) | 0.015 |
| Component b) | 0.120 |
| Phosphorylated and boronated ashless dispersant | 3.771 |
| Sul-Perm 10S | 0.480 |
| Copper corrosion inhibitor | 0.040 |
| Antifoam agent | 0.060 |
| Naugalube 438L | 0.261 |
| OLOA 216C | 0.050 |
| Octanoic acid | 0.050 |
| Tomah PA-14 | 0.050 |
| Pluronic L-81 | 0.010 |
| Mazawet 77 | 0.050 |
| PC 1244 | 0.030 |
| Diluent oil | 1.213 |
| Viscosity index improver | 5.800 |
| Red dye | 0.025 |
| Mineral oil | 87.975 |

EXAMPLE 6

| Components | |
|---|---|
| Component a) | 0.030 |
| Component b) | 0.120 |
| Phosphorylated and boronated ashless dispersant | 3.771 |
| Sul-Perm 10S | 0.480 |
| Copper corrosion inhibitor | 0.040 |
| Antifoam agent | 0.060 |
| Naugalube 438L | 0.261 |
| OLOA 216C | 0.050 |
| Octanoic acid | 0.050 |
| Tomah PA-14 | 0.050 |
| Pluronic L-81 | 0.010 |
| Mazawet 77 | 0.050 |
| PC 1244 | 0.030 |
| Diluent oil | 1.198 |
| Viscosity index improver | 5.800 |
| Red dye | 0.025 |
| Mineral oil | 87.975 |

COMPARATIVE EXAMPLE A

| Components | |
|---|---|
| Component a) | NONE |
| Component b) | 0.150 |
| Phosphorylated and boronated ashless dispersant | 3.771 |
| Sul-Perm 10S | 0.480 |
| Copper corrosion inhibitor | 0.040 |

-continued

| Components | |
|---|---|
| Antifoam agent | 0.060 |
| Naugalube 438L | 0.261 |
| OLOA 216C | 0.050 |
| Octanoic acid | 0.050 |
| Tomah PA-14 | 0.050 |
| Pluronic L-81 | 0.010 |
| Mazawet 77 | 0.050 |
| PC 1244 | 0.030 |
| Diluent oil | 1.198 |
| Viscosity index improver | 5.800 |
| Red dye | 0.025 |
| Mineral oil | 87.975 |

COMPARATIVE EXAMPLE B

| Components | |
|---|---|
| Component a) | NONE |
| Component b) | 0.300 |
| Phosphorylated and boronated ashless dispersant | 3.771 |
| Copper corrosion inhibitor | 0.040 |
| Antifoam agent | 0.020 |
| Naugalube 438L | 0.261 |
| OLOA 216C | 0.050 |
| Octanoic acid | 0.050 |
| Tomah PA-14 | 0.050 |
| Pluronic L-81 | 0.010 |
| Mazawet 77 | 0.050 |
| PC 1244 | 0.030 |
| Diluent oil | 1.568 |
| Viscosity index improver | 5.800 |
| Red dye | 0.025 |
| Mineral oil | 87.975 |

COMPARATIVE EXAMPLE C

| Components | |
|---|---|
| Component a) | NONE |
| Component b) | 0.120 |
| Phosphorylated and boronated ashless dispersant | 3.771 |
| Sul-Perm 10S | 0.480 |
| Copper corrosion inhibitor | 0.040 |
| Antifoam agent | 0.060 |
| Naugalube 438L | 0.261 |
| OLOA 216C | 0.050 |
| Octanoic acid | 0.050 |
| Tomah PA-14 | 0.050 |
| Pluronic L-81 | 0.010 |
| Mazawet 77 | 0.050 |
| PC 1244 | 0.030 |
| Diluent oil | 1.228 |
| Viscosity index improver | 5.800 |
| Red dye | 0.025 |
| Mineral oil | 87.975 |

Typical data using the Japanese Test Procedure are summarized in Tables 3 and 4. In Table 3, data on $\mu_0/\mu_d$ at 1000 cycles and at end of test (5000 cycles) are presented for the compositions of Examples 1–6 and Comparative Examples A–C. Table 4 shows that $\mu_s$ values for these same compositions at the same points of the test cycle.

TABLE 3

| $\mu_o/\mu_d$ Data Using Japanese Test Procedure | | | |
|---|---|---|---|
| ATF Composition | $\mu_o/\mu_d$ at 1000 cycles | $\mu_o/\mu_d$ at 5000 Cycles | Change In $\mu_o/\mu_d$ |
| Ex. 1 | 1.017 | 1.009 | −0.008 |
| Ex. 2 | 1.024 | 1.022 | −0.002 |
| Ex. 3 | 1.028 | 1.031 | +0.003 |
| Ex. 4 | 1.017 | 1.028 | +0.011 |

TABLE 3-continued

| $\mu_o/\mu_d$ Data Using Japanese Test Procedure | | | |
|---|---|---|---|
| ATF Composition | $\mu_o/\mu_d$ at 1000 cycles | $\mu_o/\mu_d$ at 5000 Cycles | Change In $\mu_o/\mu_d$ |
| Ex. 5 | 1.008 | 1.024 | +0.016 |
| Ex. 6 | 1.002 | 1.026 | +0.024 |
| Comp. Ex. A | 1.022 | 1.010 | −0.012 |
| Comp. Ex. B | 1.012 | 0.991 | −0.021 |
| Comp. Ex. C | 1.029 | 1.020 | −0.009 |

TABLE 4

| $\mu_s$ Data Using Japanese Test Procedure | | | |
|---|---|---|---|
| ATF Composition | $\mu_s$ at 1000 Cycles | $\mu_s$ at 5000 Cycles | Change In $\mu_s$ |
| Ex. 1 | 0.122 | 0.124 | +0.002 |
| Ex. 2 | 0.124 | 0.123 | −0.001 |
| Ex. 3 | 0.137 | 0.133 | −0.004 |
| Ex. 4 | 0.134 | 0.131 | −0.003 |
| Ex. 5 | 0.124 | 0.123 | −0.001 |
| Ex. 6 | 0.119 | 0.120 | +0.001 |
| Comp. Ex. A | 0.126 | 0.117 | −0.009 |
| Comp. Ex. B | 0.110 | 0.091 | −0.019 |
| Comp. Ex. C | 0.142 | 0.134 | −0.008 |

The data in Tables 3 and 4 indicate that the compositions of this invention did not exhibit a significant decrease in $\mu_0/\mu_d$ or $\mu_s$ during the test whereas the compositions not of this invention did experience a significant decrease in $\mu_0/\mu_d$ and $\mu_s$. The compositions of Examples 2 and 3 where particularly efficacious in maintaining substantially constant values during the test.

Typical data from test using the Ford MERCON® Clutch Friction Durability Test Procedure are summarized in Tables 5 and 6. Table 5 gives the $\mu_0/\mu_d$ results at 3100 cycles and at test end (15000 cycles) for the compositions of Examples 1 and 3 as compared to Comparative Example A. Table 6 shows the $\mu_s$ values for the same compositions at the same test cycle intervals.

TABLE 5

| $\mu_o/\mu_d$ Data Using Ford MERCON ® Test Procedure | | | |
|---|---|---|---|
| ATF Composition | $\mu_o/\mu_d$ at 3100 Cycles | $\mu_o/\mu_d$ at 15000 Cycles | Change In $\mu_o/\mu_d$ |
| Ex. 1 | 0.944 | 0.921 | −0.023 |
| Ex. 3 | 0.978* | 0.959 | −0.019 |
| Comp. Ex. A | 0.952 | 0.917 | −0.035 |

*Measured at 3000 cycles

TABLE 6

| $\mu_s$ Data Using Ford MERCON ® Test Procedure | | | |
|---|---|---|---|
| ATF Composition | $\mu_s$ at 3100 Cycles | $\mu_s$ at 15000 Cycles | Change In $\mu_s$ |
| Ex. 1 | 0.112 | 0.110 | −0.002 |
| Ex. 3 | 0.137* | 0.134 | −0.003 |
| Comp. Ex. A | 0.122 | 0.116 | −0.006 |

*Measured at 3000 cycles.

The results in Tables 5 and 6 reflect the fact that even in the more extended Ford MERCON® Test Procedure (15000 cycles), the compositions of this invention showed a substantially greater uniformity in $\mu_0/\mu_d$ and $\mu_s$ than the comparative composition not of this invention.

As used in the foregoing description, the term "oil-soluble" is used in the sense that the component in question has sufficient solubility in the selected base oil in order to dissolve therein at ordinary temperatures to a concentration at least equivalent to the minimum concentration required to achieve the results or effect for which the additive is used. Preferably, however, the solubility of such component in the selected base oil will be in excess of such minimum concentration, although there is no requirement that the component be soluble in the base oil in all proportions. Certain useful additives do not completely dissolve in base oils but rather are used in the form of stable suspensions or dispersions in the oil. Oils containing such dispersed additives of can also be employed in the practice of this invention provided such oils do not significantly interfere with the performance or usefulness of the composition in which they are employed. Given a choice, it is preferable to use any oil in which all components thereof are oil-soluble, but this is not a requirement in the practice of this invention.

The complete disclosure of each U.S. Patent cited anywhere hereinabove is incorporated herein by reference as if fully set forth in this specification.

It will be readily apparent that this invention is susceptible to considerable modification in its practice. Accordingly, this invention is not intended to be limited by the specific exemplifications presented hereinabove. Rather, what is intended to be covered is within the spirit and scope of the appended claims.

We claim:

1. A lubricant additive composition which comprises at least the following components:

a) a hydroxyalkyl aliphatic imidazoline in which the hydroxyalkyl group contains from 2 to about 4 carbon atoms, and in which the aliphatic group is an acyclic hydrocarbyl group containing from about 10 to about 25 carbon atoms; and b) a di(hydroxyalkyl) aliphatic tertiary amine in which the hydroxyalkyl groups, being the same or different, each contain from 2 to about 4 carbon atoms, and in which the aliphatic group is an acyclic hydrocarbyl group containing from about 10 to about 25 carbon atoms;

said components a) and b) being present in a mol ratio in the range of about 0.005 to about 0.50 mol of a) per mol of b).

2. A composition in accordance with claim 1 wherein the aliphatic group of said component a) is an alkenyl group, and said hydroxyalkyl group is a $\beta$-hydroxyalkyl group.

3. A composition in accordance with claim 2 wherein the hydroxyalkyl group is a $\beta$-hydroxyethyl group.

4. A composition in accordance with claim 1 wherein the aliphatic group of said component b) has in the range of 2 to 4 carbon atoms, and said hydroxyalkyl group is a $\beta$-hydroxyalkyl group, and said hydroxyalkyl groups are the same and each is a $\beta$-hydroxyalkyl group.

5. A composition in accordance with claim 4 wherein each hydroxyalkyl group is a $\beta$-hydroxyethyl group.

6. A composition in accordance with claim 1 wherein said mol ratio in the range of about 0.02 to about 0.10 mol of a) per mol of b).

7. A composition in accordance with claim 1 wherein said component a) is 1-hydroxyethyl-2-heptadecenyl imidazoline and wherein said component b) is bis(2-hydroxyethyl) tallow alkyl amine.

8. A composition in accordance with claim 7 wherein said mol ratio in the range of about 0.02 to about 0.10 mol of said component a) per mol of said component b).

9. A composition in accordance with any of claims 1–8 further comprising at least one oil-soluble phosphorus-containing ashless dispersant present in amount such that the ratio of phosphorus in said ashless dispersant to said component b) is in the range of about 0.1 to about 1.0 part by weight of phosphorus per part by weight of component b).

10. A composition in accordance with any of claims 1–8 further comprising at least one oil-soluble boron-containing ashless dispersant present in amount such that the ratio of boron in said ashless dispersant to said component b) is in the range of about 0.03 to about 0.3 part by weight of boron per part by weight of component b).

11. A composition in accordance with any of claims 1–8 further comprising at least one oil-soluble phosphorus- and boron-containing ashless dispersant present in amount such that the ratio of phosphorus in said ashless dispersant to said component b) is in the range of about 0.1 to about 0.5 part by weight of phosphorus per part by weight of component b), and such that the ratio of boron in said ashless dispersant to said component b) is in the range of about 0.05 to about 0.15 part by weight of boron per part by weight of component b).

12. A lubricant composition which comprises a major amount of at least one oil of lubricating viscosity and an friction modifying amount of the combination of:

a) a hydroxyalkyl aliphatic imidazoline in which the hydroxyalkyl group contains from 2 to about 4 carbon atoms, and in which the aliphatic group is an acyclic hydrocarbyl group containing from about 10 to about 25 carbon atoms; and b) a di(hydroxyalkyl) aliphatic tertiary amine in which the hydroxyalkyl groups, being the same or different, each contain from 2 to about 4 carbon atoms, and in which the aliphatic group is an acyclic hydrocarbyl group containing from about 10 to about 25 carbon atoms;

said components a) and b) being present in a mol ratio in the range of about 0.005 to about 0.5 mol of a) per mol of b).

13. A composition in accordance with claim 12 wherein the aliphatic group of said component a) is an alkenyl group, and said hydroxyalkyl group is a $\beta$-hydroxyalkyl group.

14. A composition in accordance with claim 13 wherein the hydroxyalkyl group is a $\beta$-hydroxyethyl group.

15. A composition in accordance with claim 12 wherein the aliphatic group of said component b) has in the range of 2 to 4 carbon atoms, and said hydroxyalkyl group is a $\beta$-hydroxyalkyl group, and said hydroxyalkyl groups are the same and each is a $\beta$-hydroxyalkyl group.

16. A composition in accordance with claim 15 wherein each hydroxyalkyl group is a $\beta$-hydroxyethyl group.

17. A composition in accordance with claim 12 wherein said mol ratio in the range of about 0.02 to about 0.10 mol of a) per mol of b).

18. A composition in accordance with claim 12 wherein said component a) is 1-hydroxyethyl-2-heptadecenyl imidazoline and wherein said component b) is bis(2-hydroxyethyl) tallow alkyl amine.

19. A composition in accordance with claim 18 wherein said mol ratio in the range of about 0.02 to about 0.10 mol of said component a) per mol of said component b).

20. A composition in accordance with any of claims 12–19 further comprising at least one oil-soluble phosphorus-containing ashless dispersant present in amount such that the ratio of phosphorus in said ashless dispersant to said component b) is in the range of about 0.1 to about 1.0 part by weight of phosphorus per part by weight of component b).

21. A composition in accordance with any of claims 12–19 further comprising at least one oil-soluble boron-containing ashless dispersant present in amount such that the ratio of boron in said ashless dispersant to said component b) is in the range of about 0.03 to about 0.3 part by weight of boron per part by weight of component b).

22. A composition in accordance with any of claims 12–19 further comprising at least one oil-soluble phosphorus- and boron-containing ashless dispersant present in amount such that the ratio of phosphorus in said ashless dispersant to said component b) is in the range of about 0.1 to about 0.5 part by weight of phosphorus per part by weight of component b), and such that the ratio of boron in said ashless dispersant to said component b) is in the range of about 0.05 to about 0.15 part by weight of boron per part by weight of component b).

23. A method of maintaining a substantially constant static breakaway coefficient of friction between a pair of friction surfaces that are periodically frictionally engaged with each other which method comprises contacting said surfaces with a lubricant composition which comprises a major amount of at least one oil of lubricating viscosity and an friction modifying amount of the combination of:

a) a hydroxyalkyl aliphatic imidazoline in which the hydroxyalkyl group contains from 2 to about 4 carbon atoms, and in which the aliphatic group is an acyclic hydrocarbyl group containing from about 10 to about 25 carbon atoms; and b) a di(hydroxyalkyl) aliphatic tertiary amine in which the hydroxyalkyl groups, being the same or different, each contain from 2 to about 4 carbon atoms, and in which the aliphatic group is an acyclic hydrocarbyl group containing from about 10 to about 25 carbon atoms;

said components a) and b) being present in a mol ratio in the range of about 0.005 to about 0.5 mol of a) per mol of b).

24. A method in accordance with claim 23 wherein the aliphatic group of said component a) is an alkenyl group, wherein the aliphatic group of said component b) has in the range of 2 to 4 carbon atoms, and wherein the hydroxyalkyl groups of said components a) and b) each is a $\beta$-hydroxyalkyl group.

25. A method in accordance with claim 23 wherein each hydroxyalkyl group is a $\beta$-hydroxyethyl group.

26. A method in accordance with claim 23 wherein said component a) is 1-hydroxyethyl-2-heptadecenyl imidazoline, wherein said component b) is bis(2-hydroxyethyl) tallow alkyl amine, and wherein said mol ratio in the range of about 0.02 to about 0.10 mol of said component a) per mol of said component b).

27. A method in accordance with claim 23 wherein said pair of friction surfaces are friction surfaces within an automatic transmission.

* * * * *